United States Patent [19]

Vargo

[11] Patent Number: 4,538,379

[45] Date of Patent: Sep. 3, 1985

[54] SAFETY MEZZANINE GATE

[76] Inventor: William R. Vargo, 2101 Randall Ave., Lithonia, Ga. 30058

[21] Appl. No.: 550,777

[22] Filed: Nov. 14, 1983

[51] Int. Cl.[3] ..... E05D 15/00

[52] U.S. Cl. ..... 49/381; 49/385

[58] Field of Search ..... 49/381, 385, 390

[56] References Cited

U.S. PATENT DOCUMENTS 1,494,290 5/1924 Ruhmann ..... 49/381 X 4,041,646 8/1977 Mittag ..... 49/385

4,328,643 5/1982 Bell ..... 49/381

*Primary Examiner*—Kenneth Downey

*Attorney, Agent, or Firm*—Body, Vickers & Daniels

[57] ABSTRACT

An improved gate assembly for a guard-railing around a mezzanine storage area comprised of a U-shaped gate member mounted on a horizontal axis and pivotally movable between a first position wherein a barrier portion of the gate member traverses an opening in the guard railing and a second position wherein the barrier portion is removed from the opening.

13 Claims, 6 Drawing Figures

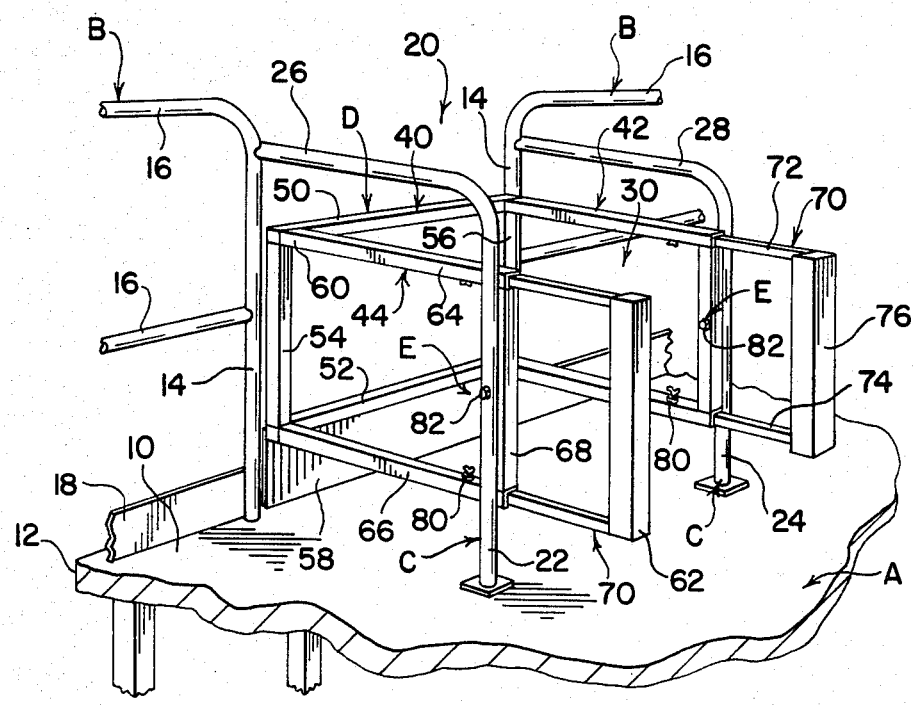
FIG. 1
FIG. 2
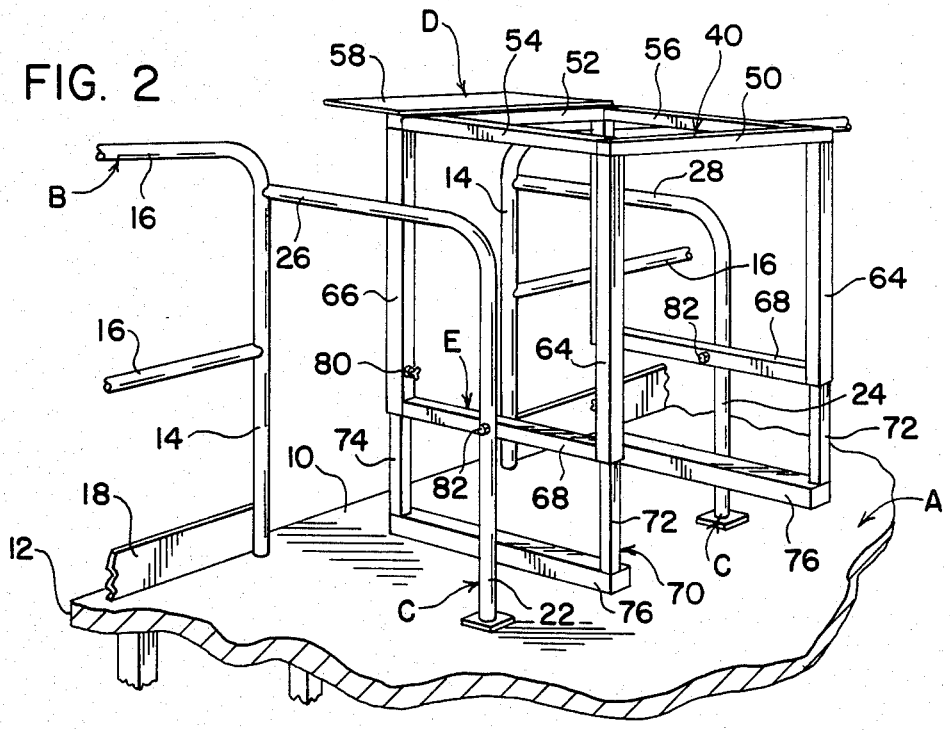

SAFETY MEZZANINE GATE

BACKGROUND OF THE INVENTION

The present invention relates to gate assemblies and, more particularly, to a gate assembly for a guardrailing or barrier surrounding an elevated floor or platform. The invention is particularly applicable for use with a railing about the periphery of a mezzanine storage area and will be described with particular reference thereto, although it will be appreciated that the invention has other broader applications.

A mezzanine is an intermediate floor or platform erected between two main floors or levels of a building. Such intermediate floors or platforms are well known and widely used in business and industry to utilize overhead space for storing various articles such as inventory items, stock material, tools, raw materials, spare machinery parts and the like. These mezzanine storage areas are generally comprised of an elevated platform which supports shelves or other storage cubicles. Normally the articles to be stored are delivered to the mezzanine on skids or pallets by a fork truck. The pallets are lifted from ground level up to the mezzanine platform and placed just within the outer edge of the mezzanine. Once upon the elevated platform, the articles are then removed from the pallet and stored by a worker.

Because of the potential hazard of falling off these elevated platforms which exist for the workers, government regulations require a guard or railing be provided about the periphery of the mezzanine floor or platform. Likewise, a toe-board or floor guard of a specified size is required to extend upward from the surface of the platform to protect workers below the mezzanine from objects which may be kicked off, or may be dropped from, the edge of the mezzanine platform. The railing and toe-board however create an impediment to the placement of articles on the mezzanine by means of a pallet and fork truck, and therefore some type of opening and gate arrangement is required.

Various structural arrangements have been created to attempt to provide a safe opening in the guard railing. In some instances a swinging gate has been provided, which gate can be opened and swung to one side when a pallet is to be set on the mezzanine platform. A problem with this arrangement, however, is that the gate cannot be closed when the pallet is set on the mezzanine in that the pallet itself obstructs the movement of the gate. The gate therefore remains open until the articles are removed from the pallet and the pallet is taken away. This creates a hazardous situation where articles could be knocked off the pallet to the work area below, or the workmen themselves could trip or stumble while working over the pallet and fall through the opening.

Another arrangement provides for a section of the guard railing to be removed and a chain to be secured across the opening as a temporary barrier. Attendant this arrangement, is the time consuming, and dangerous situation of the worker removing an awkward and heavy railing section while standing at the edge of the platform. Likewise, as with the gate arrangement previously discussed, the railing section cannot be safely replaced until the pallet is removed, and the chain cannot replace the toe board or offer the protection of a solid bar or railing.

Some arrangements attempt to provide a structure which can be closed immediately after a pallet is set on the platform. For example, some structures include an expandable and collapsible, accordion-like gate, or a gate with a telescoping section. A prominent problem with these arrangements is that the worker or operator is required to either reach across the opening or stand on the pallet itself to pull the gate shut, thereby creating a dangerous situation wherein he may trip or stumble over the pallet and articles, and fall through the opening. Likewise, these mechanical arrangements are undesirable because of the pinch-points created by the telescoping structural members, and a scissor like action of a collapsible gate.

Thus gate arrangements for mezzanine platforms known heretofore do not offer satisfactory protection to the workers on the mezzanine or to those below, and do not provide a gate arrangement which can meet safety regulations when a pallet of articles is set on the mezzanine platform.

SUMMARY OF THE INVENTION

The present invention overcomes these and other problems and provides a gate assembly for mezzanines or other elevated platforms which provides a solid barrier meeting safety regulations, and which barrier is movable between an open and closed position. The gate assembly is easily operated by a worker who at all times remains a safe distance from the opening and edge of the platform, and which gate assembly may be closed immediately after the pallet of articles has been set on the platform.

In accordance with the present invention a gate assembly for an opening in a platform railing is provided including a generally U-shaped gate member having a barrier portion for traversing the opening in the platform railing, and side portions at each end of the barrier portion extending laterally in the same direction from one side thereof, wherein the side portions are pivotally mounted about a horizontal axis to structural means secured to the platform, such that the gate member is pivotally movable between a first position where the barrier portion of the gate member is positioned in and traverses the railing opening, and a second position where the barrier portion is removed from the opening.

Further in accordance with the present invention, weighted sections are included on the side portions of the U-shaped gate member, which weighted sections are positioned relative to the barrier portion such that the horizontal axis lies therebetween, and the gate member is balanced about the horizontal axis. To allow for rotation of the gate member about the horizontal axis, the spacing between the horizontal axis and the surface of the platform, must be at least as great as the spacing between the horizontal axis and the point of the weighted section which is furthest from the horizontal axis.

An outstanding object of the present invention is to provide a gate assembly for a guard railing on an elevated platform which assembly allows for safe easy access therethrough for articles to be stored on the platform.

Another object of the present invention is to provide a gate assembly of the foregoing character which allows a worker on the platform to operate the gate and maintain a safe distance from the gate opening.

A still further object of the present invention is the provision of a gate assembly of the foregoing character having a rigid barrier portion which is movable about a horizontal axis.

A still further object of the present invention is to provide a gate assembly of the foregoing character which is economical to make, and simple and easy to use.

BRIEF DESCRIPTION OF THE DRAWINGS

These and other objects and advantages will become apparent from the description of a preferred embodiment of the invention illustrated in the accompanying drawings in which:

FIG. 1 is a perspective view of a platform guard railing including a gate assembly in accordance with the present invention, which gate assembly is shown in a closed position;

FIG. 2 is a perspective view showing the gate assembly of FIG. 1 in an opened position;

DETAILED DESCRIPTION OF A PREFERRED EMBODIMENT

Figure 3:
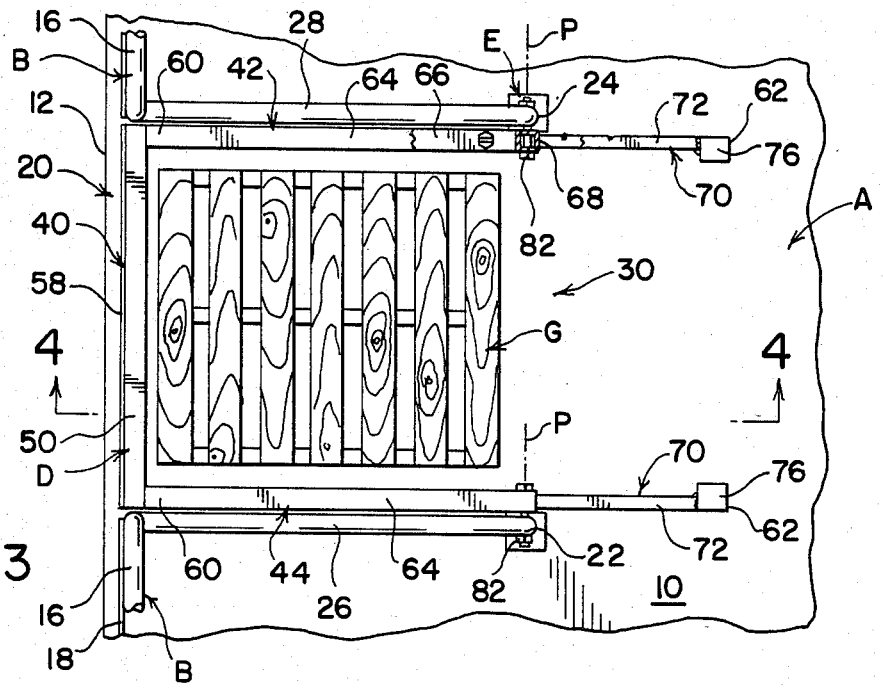
FIG. 3 is a plan view of the gate assembly shown in FIG. 1.

Referring now to the drawings wherein the showings are for the purpose of illustrating a preferred embodiment of the invention only, and not for the purpose of limiting the same, the Figures show a mezzanine floor or platform A having a guard railing B secured thereto about its peripheral edge. Associated with platform A and railing B is a gate assembly having structural support C mounted to the platform, and a U-shaped gate member D mounted to the structural support by mounting arrangement E.

Mezzanine platform A and guard railing B in and of themselves form no part of the present invention and therefore a detailed description of platform A and railing B is not necessary. Briefly stated, platform A represents an elevated structure erected above a main floor or level of a building. In the orientation show, platform A has an upper surface 10 and a peripheral edge 12. Guard railing B is located along edge 12 of platform A and is rigidly secured thereto. Guard railings along edges of platforms are commonly known. These railings are generally of steel-pipe construction, and depending on the composition of platform A are secured thereto in a number of relatively conventional ways such as bolting, welding or the like. Railing B includes upright rail members 14 and horizontal rail member 16. Horizontal rail members 16 are located at predetermined heights above surface 10, and connect adjacent upright members 14 to one another. A toeguard or floor-board 18 is provided along surface 10 between adjacent upright members 14. An opening 20 is provided in the railing by omitting two horizontal members 16. Opening 20 is defined by upright members 14 and platform surface 10 and supplies an access to and from platform A.

Gate support structure C is comprised of two upright posts 22 and 24 spaced from one another in side-by-side relationship. Posts 22 and 24 are situated on platform A a predetermined distance from opening 20, and are fixedly secured to platform A by conventional means. The spacing between posts 20 and 22 is preferably equal to the spacing between the two upright rail members 14 defining opening 20. Extending toward opening 20 from upright posts 22 and 24 are support braces 26 and 28, respectively. As shown in FIG. 2, braces 26 and 28 are integral with upright posts 22 and 24 and are secured to uprights 14 thus defining a corridor 30 therebetween. The railing, posts, braces and gate member to be described herein are all of steel construction. It will be appreciated that other shapes and material may be used without deviating from the present invention.

U-shaped gate member D is positioned between upright posts 22 and 24 as shown in the drawings. Gate member D is comprised of a barrier portion 40 and two side portions 42 and 44. Barrier portion 40 is comprised of upper horizontal beam member 50, lower horizontal beam member 52 and vertical struts 54 and 56. Beam members 50 and 52, and struts 54 and 56 are each of tubular construction, and together form a rectangular frame. The length of horizontal members 50 and 52, i.e. the length of barrier portion 40, is slightly less than the distance between upright rail members 14 which define opening 20. A gate floor-guard 58 is provided on barrier portion 40 and secured to lower horizontal beam 52.

Side portions 42 and 44 are located at each end of barrier portion 40 and extend laterally in the same direction from one side thereof. Side portions 42 and 44 are parallel to each other and each have a fixed end 60 secured to barrier portion 40 and a free end 62. Side portions 42 and 44 are basically identical to one another and therefore only one side portion will be described in detail. Side member 42 is comprised of upper and lower side members 64 and 66 which are horizontal and parallel to each other. The ends of these members are secured to barrier portion 40. A vertical strut 68 is positioned between members 64 and 66 at the other end. The side members and vertical struts are each of tubular construction similar to barrier portion 40. Side portions 42 and 44 also include a weighted section 70 comprised of legs 72 and 74, which are horizontal and parallel to each other, and an elongated vertical weight 76 which is secured to one end of legs 72 and 74. Legs 72 and 74 are adapted to have outer dimensions which enable them to be positioned, and reciprocally movable within the interior opening of tubular side members 64 and 66. A telescoping arrangement is thereby provided between weighted section 70 and its respective side portion. Weight 76 of section 70 defines the free end 62 of the side portions. Locking means 80 are provided on the sides of members 64 and 62 to secure section 70 with side portions 42 and 44. Locking means 80 are comprised of a nut and thumb screw arrangement as is conventionally known.

When viewed from above as in FIG. 3, barrier portion 40 and side portions 42 and 44 define a generally U-shaped gate member D. Gate member D is adapted to be positioned between support posts 22 and 24 such that when barrier portion 40 is located in and traverses opening 20, vertical struts 68 of side portions 42 and 44 are adjacent to support posts 22 and 24. Holes provided in posts 22 and 24, and struts 68 enable gate member D to be pivotally mounted to the posts by a nut and bolt combination 82. The holes through struts 68 and posts 22 and 24 are aligned along a horizontal axis P, which allows pivotal movement of gate member D from a first position, as shown in FIG. 1, wherein barrier portion 40 traverses opening 20, to a second position, wherein barrier portion 40 is removed from the opening. The second, opened position may generally be any position of gate member D which would allow a loaded pallet to be placed on the mezzanine. The position of gate member D can be as shown in FIG. 2, wherein the gate member is approximately 90° from the first position shown in FIG. 1. Mechanical stops (not shown) mounted on gate member D or on structural supports 22 and 24 could be provided to limit movement of the gate member to this position. In such position, barrier portion 40 is approximately parallel to platform surface 10.

Figure 5:
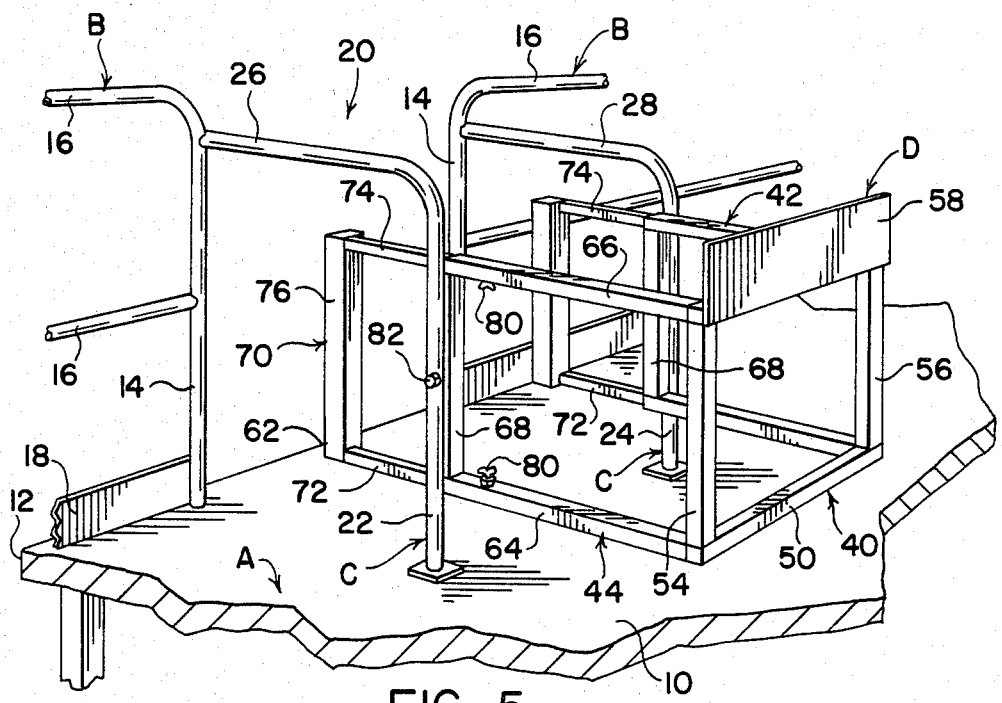
FIG. 5 is a perspective view showing the gate assembly of FIG. 1 in a preferred open position; and, FIG. 6 a perspective view of a gate assembly in accordance with the present invention, wherein the gate assembly is located at the corner of a platform.

Alternately, and preferrably, the second, opened position is as shown in FIG. 5 wherein the gate is approximately 180° from its original first closed position. As can be seen, when in this position, a solid barrier in the form of gate member D and support braces 26 and 28 completely surround the pallet loading area. A worker on the mezzanine is completely screened from access to opening 20.

The position of axis P relative to railing B and platform surface 10 may be varied depending on several factors such as the length of side portions 42 and 44, the desired clearance of barrier portion 40 above surface 10 when the gate is opened, and the clearance necessary between weight section 70 and surface 10 as the gate member is rotated. The gate may be pivoted around any horizontal axis so long as a sufficient opening is obtained for passage of the desired objects therethrough, and the movement of the free end of gate member D, i.e. the portion of the gate member pivoted toward surface 10, is not obstructed by surface 10.

Figure 4:
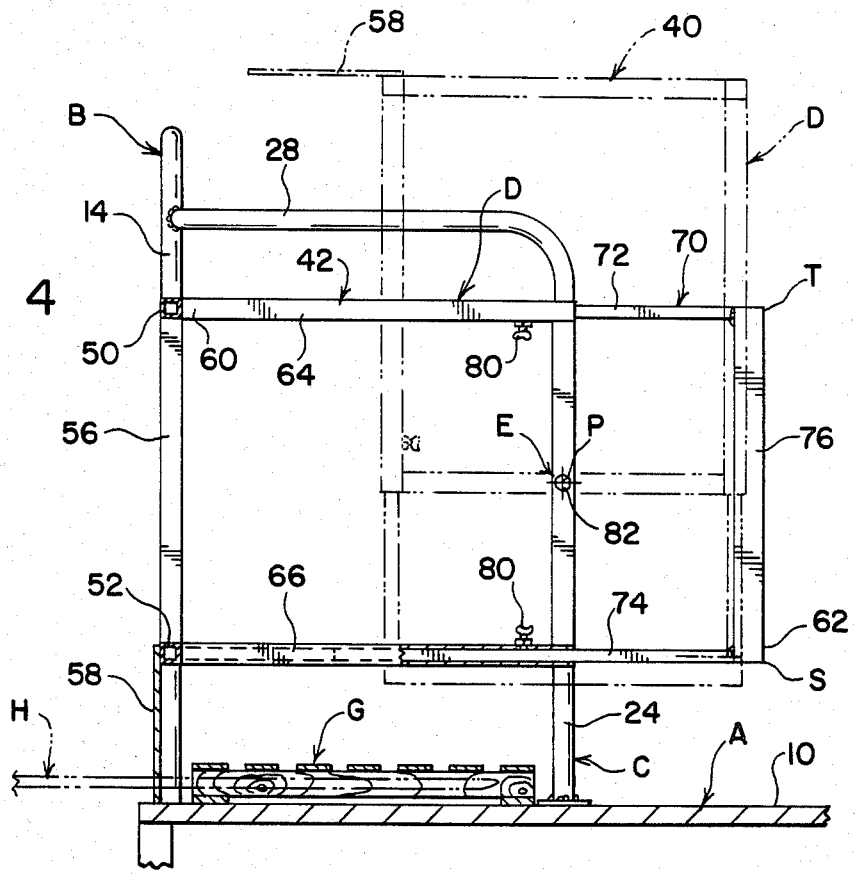
FIG. 4 is a cross-sectional view taken along line 4—4 of FIG. 3 and showing in phantom the gate member in an open position.

With respect to movement of the free end of the gate member, the spacing between axis P and surface 10 must be at least as great as the spacing between axis P and the point on section 70 which is furthest from axis P. As best seen in FIG. 4, because axis P is generally centrally located in side portions 42 and 44, points S and T on weight 76 are the furthest parts of the gate member from axis P, and therefore axis P is spaced from surface 10 a distance sufficient to enable points S and T to pivot past surface 10. It will be appreciated, that with any telescoping counterweight arrangement similar to the embodiment disclosed herein, the spacing between axis P and surface 10 must be sufficient to accommodate the extreme position of the counterweight from axis P.

In operation, gate member D would be in the first closed position, as shown in FIG. 1, when no pallets G or articles are to be moved to or from the mezzanine. Telescoping sections 70 on side portions 42 and 44 can be adjusted such that counterweight 76 balances most or all of the weight of gate member D. It is of course important that sufficient weight be maintained on the barrier side of axis P, or other means be provided to insure the gate remains in the first closed position when not in use. When properly balanced, the gate member can be easily rotated to a preferred second open position, as shown in FIG. 5, by a single individual. A worker standing to one side of gate member D, can easily rotate the balanced gate to an opened position as shown in FIG. 5. With gate member D in the open position, a pallet of articles can easily be set on the mezzanine by a fork truck. The worker can conduct other duties while waiting for or during the loading, while at all times being protected from potential accidents by the gate member and horizontal braces. When the pallet is in place on the mezzanine and the forks H of the truck are removed, the gate can be easily returned to the closed position to provide a solid barrier having a floor guard across opening 20, thus allowing the worker to move around or on the pallet safely.

It will be appreciated that numerous modifications as to the shape, configuration and size of the gate assembly can be made without deviating from the scope of the present invention. For example, with regard to gate member D, the number of and the spacing between horizontal beam members of barrier portion 40 is not critical, so long as barrier portion 40 is of sufficient height and strength to provide a suitable guard or barrier to protect a worker. Likewise, side portions 42 and 44 may be of different configurations.

Figure 6:
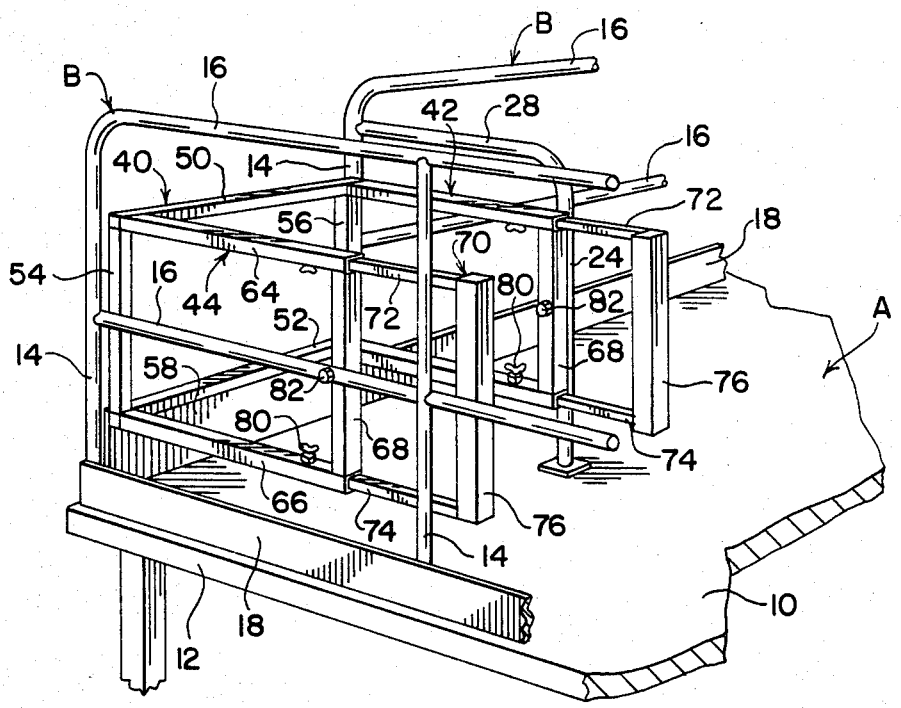

Structural supports C which support gate member D may be any structure to which gate D may be pivotally mounted. A permanent wall section of a building may be used in conjunction with a structural post of the type shown in the drawings to provide a gate assembly near a wall. Likewise, as shown in FIG. 6, a gate assembly may be positioned at a corner of a mezzanine platform and use a horizontal rail member 16 as a structural support to which the gate is pivotally mounted. With this arrangement one edge of the mezzanine and its guard railing B would be adjacent and parallel to the side portions of gate member D.

It will also be appreciated that a gate assembly according to the present invention is suitable for other types of barriers other than a pipe railing structure as shown in the drawings. For example, the present invention may be used with cage-like structures of expanded metal or woven wire, or even chain-link fencing.

Though illustrated as a manually operated gate, the present invention is readily adaptable to operation by hydraulic cylinders, motors or other mechanical devices. These and other modifications and alterations will occur to others upon their reading and understanding of this specification. It is intended that all such modifications and alterations be included insofar as they come within the scope of the patent as claimed or the equivalence thereof.

Having thus described the invention, the following is claimed.

1. A gate assembly for an opening in a platform railing comprising:

a generally U-shaped gate member having a barrier portion for traversing said opening and side portions at each end of said barrier portion extending laterally generally in the same direction from one side thereof;

gate supporting means secured to said platform and located adjacent said side portions of said gate member; and means for mounting said gate member to said gate supporting means for pivotal movement of said gate member about a horizontal axis, between a first position where said barrier portion is positioned in and traverses said opening and a second position where said barrier portion is removed from said opening.

2. A gate assembly as defined in claim 1, wherein said horizontal axis extends through said side portions and is spaced from said barrier portion.

3. A gate assembly as defined in claim 2, wherein said side portions of said gate member are generally parallel to each other and perpendicular to said horizontal axis.

4. A gate assembly as defined in claim 3, wherein said railing extends around the periphery of said platform and has upright rail members secured to said platform with horizontal rail members at a predetermined height above said platform connecting each upright rail member to an adjacent upright rail member and wherein said barrier portion includes at least one beam member traversing said opening at a predetermined spacing above said platform when said gate member is in said first position.

5. A gate assembly as defined in claim 4, wherein said side portions of said gate member includes a free end extending beyond said axis away from said barrier portion, said free end being spaced from said horizontal axis to allow pivotal movement of said free end between said axis and said platform.

6. A gate assembly as defined in claim 5, wherein said free end includes means balancing said gate member about said axis.

7. A gate assembly as defined in claim 6, wherein said balance means are weights secured to said free ends of said gate member.

8. A gate assembly as defined in claim 5, wherein said side portion includes means for extending the length of said side portion.

9. A gate assembly as defined in claim 8, wherein said gate member is of tubular frame construction, wherein said barrier portion and side portions of said gate members are generally planar.

10. A gate assembly as defined in claim 3, wherein said gate member rotates at least 90° about said axis between said first position and said second position.

11. A gate assembly as defined in claim 3, wherein said side portions of said gate member include a free end away from said barrier portion and spaced from said horizontal axis, said free end having means for balancing said gate member about said axis.

12. A gate assembly as defined in claim 4, wherein said supporting means are upright posts secured to said platform adjacent said side portions.

13. A gate assembly as defined in claim 4, wherein said supporting means comprises an upright post secured to said platform adjacent one side portion of said gate member, and a horizontal rail member adjacent the other side portion of said gate member.

* * * * *